US006666272B2

(12) United States Patent
Singeetham et al.

(10) Patent No.: US 6,666,272 B2
(45) Date of Patent: Dec. 23, 2003

(54) EXTERNALLY ACTUATED SUBSEA WELLHEAD TIEBACK CONNECTOR

(75) Inventors: Shiva P. Singeetham, Houston, TX (US); Russell E. McBeth, The Woodlands, TX (US); Robert B. Baten, Houston, TX (US)

(73) Assignee: FMC Technologies, Inc., Chicago, IL (US)

( * ) Notice: Subject to any disclaimer, the term of this patent is extended or adjusted under 35 U.S.C. 154(b) by 0 days.

(21) Appl. No.: 10/072,044

(22) Filed: Feb. 4, 2002

(65) Prior Publication Data

US 2003/0145996 A1 Aug. 7, 2003

(51) Int. Cl.[7] ..... E21B 29/12
(52) U.S. Cl. ..... 166/345; 348/359; 348/125
(58) Field of Search ..... 166/125, 348, 166/359, 345

(56) References Cited

U.S. PATENT DOCUMENTS 3,325,190 A * 6/1967 Exkert et al. ..... 285/18
3,336,976 A * 8/1967 Word, Jr. ..... 166/336
3,345,087 A * 10/1967 Hanes et al. ..... 285/39
3,450,421 A * 6/1969 Harwell, Jr. ..... 285/24
3,492,027 A * 1/1970 Herring ..... 285/18
3,628,812 A * 12/1971 Larralde et al. ..... 285/24
3,902,743 A * 9/1975 Martin ..... 285/39
4,139,222 A * 2/1979 Loland ..... 285/27
4,433,859 A * 2/1984 Driver et al. ..... 285/34
4,453,745 A * 6/1984 Nelson ..... 285/18
4,456,070 A * 6/1984 Watkins ..... 166/345
4,489,472 A * 12/1984 Cabrit et al. ..... 29/426.5
4,611,829 A * 9/1986 Hughes ..... 285/18
4,696,493 A * 9/1987 Brammer ..... 285/3
5,247,996 A * 9/1993 Milberger ..... 166/348
5,259,459 A 11/1993 Valka
5,332,043 A * 7/1994 Ferguson ..... 166/379
5,441,310 A * 8/1995 Barrett et al. ..... 285/18
5,566,761 A 10/1996 Pallini, Jr. et al.
5,775,427 A 7/1998 Skeels et al.

* cited by examiner

*Primary Examiner*—Thomas B. Will
*Assistant Examiner*—Thomas A. Beach
(74) *Attorney, Agent, or Firm*—Gary L. Bush; Andrews Kurth LLP

(57) ABSTRACT

An externally actuatable tieback connector for establishing fluid communication and force resisting connection of a conduit to a subsea wellhead having an internal locking geometry. The tieback connector has a body structure that is adapted for landing on a wellhead, with a part thereof extending into the wellhead and carrying a split lock ring. A lock energizing element, moveable relative to the body structure, has a locking position expanding the lock ring into locking and pre-load force transmitting engagement with the internal locking geometry of the wellhead and an unlocking position releasing the tieback connector from the wellhead. One or more drive members extend from the lock energizing element and are exposed externally of the connector body and wellhead for engagement and actuating movement by a lock actuating tool such as a ROV or the like.

16 Claims, 3 Drawing Sheets

10
30
118
32
106
126
114
102
78
74
122
38
40
44
96
68
70
14
46
15
50
12
22
16
18
124
110
76
120
90
92
72
64
66
20
24
28
26
82
104
112
108
128
116
86
84
80
34
88
36
42
98
100
48
94
60
58
56
62
54
53

130
118
140
144
132
102
122
96
68
70
72
14
46
53
50
22
12
84
136
88
20
26
28
78
82
104
146
142
138
134
84
86
80
34
49
48
56
54

186
184
150
188
182
178
176
180
20
160
158
164
162
156
168
166
34
172
84
170
35
38
36
40
88
42
49
96
68
73
48
72
14
56
154
46
50
22
12

EXTERNALLY ACTUATED SUBSEA WELLHEAD TIEBACK CONNECTOR

BACKGROUND OF THE INVENTION

1. Field of the Invention

The present invention relates to subsea wellhead and pipe connectors, and more particularly to axially locking connectors for tying back to subsea wellheads with well conductor or riser pipe. Even more specifically, the present invention concerns a passive wellhead tieback connector having an internal lock mechanism which is externally mechanically actuated such as by a remote operated vehicle (ROV) controlled tieback actuator tool. Even further, the present invention is provided with an adjustment mechanism which can be adjusted on the working deck of the drilling and production vessel or spar or adjusted in the subsea environment to develop a high pre-load force of the lock mechanism during connector installation, enabling the releasable connector to withstand loads generated by spars, tension leg platforms (TLP's) and any other floating riser support structures.

2. Description of the Prior Art

The development of offshore petroleum oil and gas deposits from undersea wells involves drilling production wells in the sea bed from a drilling platform, and then capping the wellhead at the ocean floor until a production platform, either stationary of floating, is put into place on the surface of the ocean. To commence production from a subsea well, large diameter marine riser pipe is run downward from the production platform and connected to the subsea wellhead, a procedure known as tying back to the wellhead.

Several types of tieback connectors are available to connect or tie back production risers to wellheads. Certain of these connectors require rotation of a riser string to lock them to, and release them from, the wellhead housing. However, when rotating to the left to unlock the connector, the joints in the riser string tend to unthread and loosen. Reconnecting these loosened joints can be a serious and costly problem to the operator.

To solve this problem, tieback connectors that are actuated by axial movement have been developed to provide a connection to, and disconnection from a wellhead without rotary motion. In certain of such connectors, a pre-load force can be imposed through the connector's lock ring and onto the wellhead housing. Prior devices also include adjustment of the pre-load force through cumbersome changes between the relative positions of the inner body and outer body forming such connectors. However, such connectors are not constructed to provide an adequate pre-load force between a lock ring on the connector and the wellhead, and may not be adequate to maintain the locking force when extreme production fluid pressures are encountered which tend to separate the riser from the wellhead.

One approach is disclosed in U.S. Pat. No. 5,259,459 to Valka titled "Subsea Wellhead Tieback Connector," which is directed to a wellhead tieback connector actuated solely by axial motion to achieve connection and disconnection from the subsea wellhead using a type of expanding lockdown ring and a type of adjustment assembly. After the connection is made between the tieback connector and the wellhead, the apparatus taught by this patent is used to effectuate a rigid lockdown, thereby eliminating any slippage that exists in the manufacturing or installation tolerances in the riser pipe being connected.

The advent of spar-type floating production facilities has increased the need for a premium, high force-resistant, tieback connection system for affixing a riser pipe conduit from pre-drilled subsea wellheads to completion trees at the surface within the spar's structure. One unique problem that a spar presents is the limited space from which to lower and install a riser pipe conduit and tieback connector since the inside diameter of the pipe will only permit passage of equipment 26 inches in diameter or smaller.

In addition to the small profile requirements, the subsea tieback connection system must be resistant to extreme external bending and axial loads in addition to the pressures generated from the well. A tieback connection system is required which can generate sufficient locking force to resist separation forces in excess of 800,000 pounds, which is often referred to as a connector's pre-load force.

SUMMARY OF THE INVENTION

To generate this force in a tieback connector, the present invention provides a structure wherein the relative location between a recessed groove in the wellhead and a lock ring forming part of the tieback connector can be readily adjusted to provide maximum pre-load. The lock ring is actuated to expand into the wellhead groove, and beveled engagement surfaces on the lock ring and wellhead groove interact in cam-like fashion to develop the necessary pre-load force.

The tieback connector of the present invention is considered "passive" in that it does not incorporate an internal hydraulic or otherwise powered mechanism for accomplishing locking and unlocking thereof with respect to a subsea wellhead. In accordance with the present invention, there is provided a tieback connector that has a tubular outer connector body that is adapted to rest axially upon an upper surface of the wellhead. The tieback connector has an inner body that is adapted to extend partially into an inner diameter of the wellhead. A lock ring, being a split ring having spring-like characteristics, extends circumferentially around a portion of the inner body and is adapted for expansion into locking engagement with internal locking geometry of a wellhead component for establishing locking connection of the tieback connector to the wellhead. An energizing mandrel is in linearly moveable assembly with the tieback connector and has an elongate tubular extension that extends axially between the wellhead and the inner body, with a lower end of the tubular extension oriented for expansion of the lock ring. The energizing mandrel is moved linearly for expanding the lock ring into the internal locking geometry of the wellhead and thus lock the tieback connector to the wellhead. An elongate tubular adjustment element or ring extends around and is operatively connected to the inner body, the adjustment ring positioned beneath and in positioning and supporting contact with a lower annular surface of the lock ring. The tubular adjustment element is capable of axial movement relative to the inner tubular body of the tieback connector to alter the axial position of the lock ring relative to the inner body to establish an adjustable tensile pre-load force on the tieback connector as the lock ring is forced into fully engaged locking engagement with the internal locking geometry of the wellhead. One or more tubular elements, including a tubular lock positioning element are subjected to axially compressive force, developed by the cam-like activity of the lock ring with the internal locking geometry of the wellhead, and thus then to yield or buckle to provide a cushioning activity or compressive spring pre-load force.

The structure of the present invention provides a significant mechanical advantage between a linearly moveable lock actuator assembly and the lock ring which compresses the lock ring into the internal wellhead locking groove. Further, the tieback connector of the present invention is specifically constructed whereby mating locking parts under compressive force in the tieback connector bend and/or buckle to create a tensile pre-load force acting on the inner tubular body of the tieback connector.

To accomplish a high force-resistant tieback connection pursuant to the above objectives, the expanding lock ring of the connector is positioned a short distance above the internal recessed locking groove within the wellhead such that upon contact, the tapered shoulders between the lock ring and wellhead groove stretch the inner connector body down until the lock ring fully enters the internal locking groove, thus developing sufficient tensile force to generate a desired pre-load. The relative position of the lock ring to the internal wellhead locking groove is adjusted by a threaded tubular adjustment member or ring having axial positioning and supporting relation with the lock ring. Rotation of the adjustment member on the inner tubular body imparts axial movement to the lock ring to accommodate differences in machining tolerances between the wellhead housing and the tieback connector and to pre-apply the desired amount of tensile pre-load force to the inner tubular body of the tieback connector.

To provide the necessary mechanical advantage between the lock ring and the lock energizing mandrel which expands the lock ring into the wellhead groove, with application of minimal force with the energizing mandrel, which minimal force can be applied by a ROV, a tapered lock ring actuation shoulders are provided on the tubular extension of the energizing mandrel and on the lock ring which are in contact as the energizing mandrel is actuated. When the lock ring action shoulders or surfaces pass by each other during the locking process, a small relative angle is taken by the load path, resulting in a significant mechanical advantage between the two parts, in the range of 27:1 in the preferred embodiment of the invention. By way of example, in one embodiment of the present invention, a linear force applied by a ROV on the externally exposed drive members of the energizing mandrel generates approximately 29,500 pounds of downward force, which translates to 810,000 pounds of pre-load locking force acting on the lock ring.

A further feature of the present invention is to provide certain parts having a design geometry such that these parts bend or buckle to create a compressive spring pre-load force. This compressive spring force is introduced by making the tubular adjustment element or ring and an adjustable tubular lock positioning element long and slender, whereby compressive deflection thereof is provided under load. Since both of these elements are fully captured on all sides by more rigid components, the deflection or buckling of these two parts is restrained against failure and therefore the two parts are fully supported. The stored energy of the adjustable tubular connector element and the tubular lock positioning element, in combination with the stretch associated with axially loading the tieback connector's main body provide the necessary stretch and stored energy for generating the required pre-load force.

The oil and gas production fields that are being tied back to the surface are getting larger and larger. Currently the tieback connectors are actuated hydraulically, such as is shown in commonly assigned U.S. Pat. No. 5,775,427, covering an internally locked subsea wellhead tieback connector. If the internal hydraulically energized lock actuation mechanism of the tieback connector can be eliminated, thus rendering the tieback connector passive, the cost of manufacturing the tieback connector can be significantly reduced. When a portion of the energizing mandrel of the tieback connector is externally exposed for actuation by a ROV or other similar equipment, the tieback connector can be actuated for locking and unlocking without sacrificing its functional integrity.

BRIEF DESCRIPTION OF THE DRAWINGS

So that the manner in which the above recited features, advantages and objects of the present invention are attained and can be understood in detail, a more particular description of the invention, briefly summarized above, may be had by reference to the preferred embodiment thereof which is illustrated in the appended drawings, which drawings are incorporated as a part hereof.

It is to be noted however, that the appended drawings illustrate only a typical embodiment of this invention and are therefore not to be considered limiting of its scope, for the invention may admit to other equally effective embodiments.

IN THE DRAWINGS

Figures 1A, 1B:
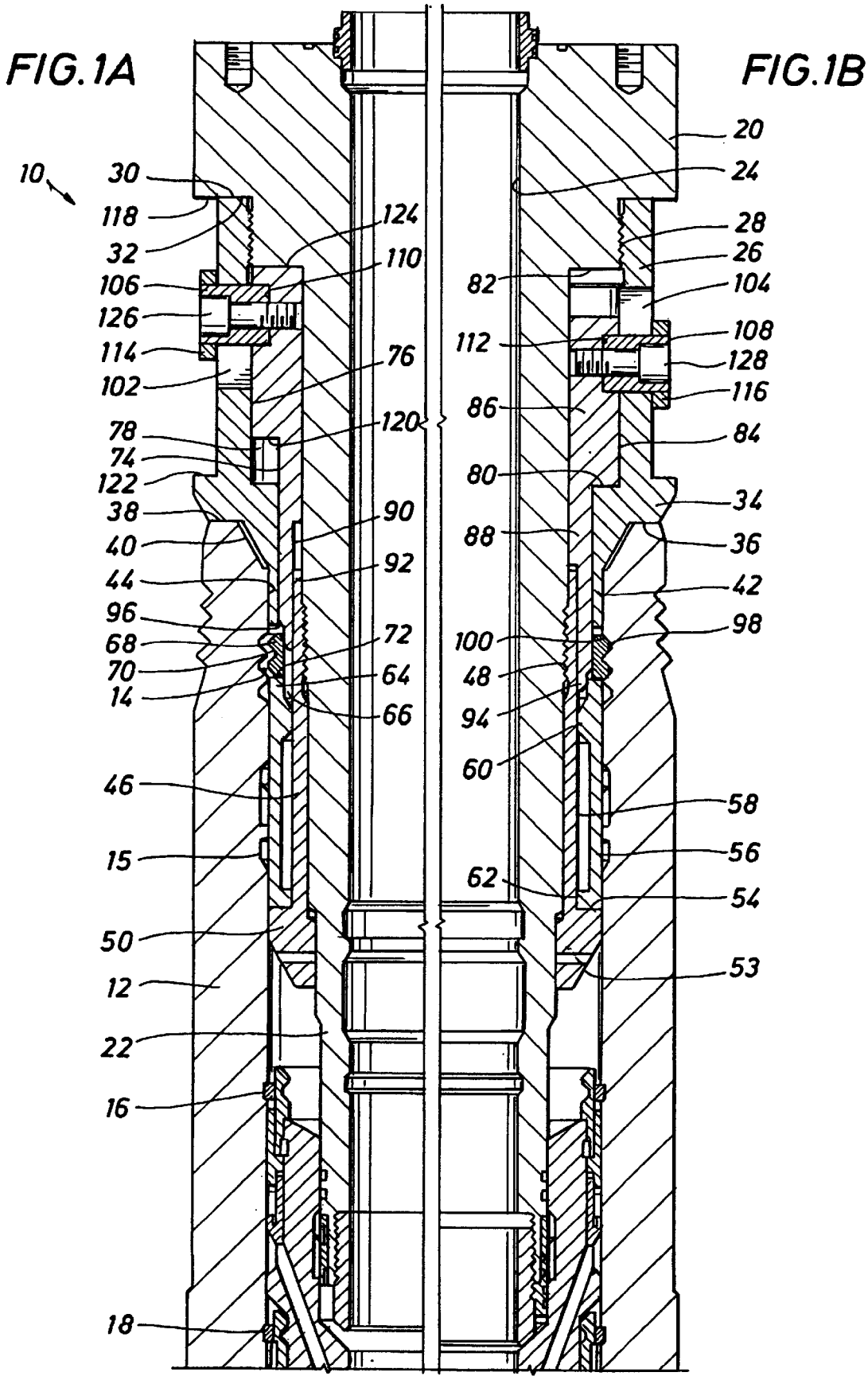
Figures 2A, 2B:
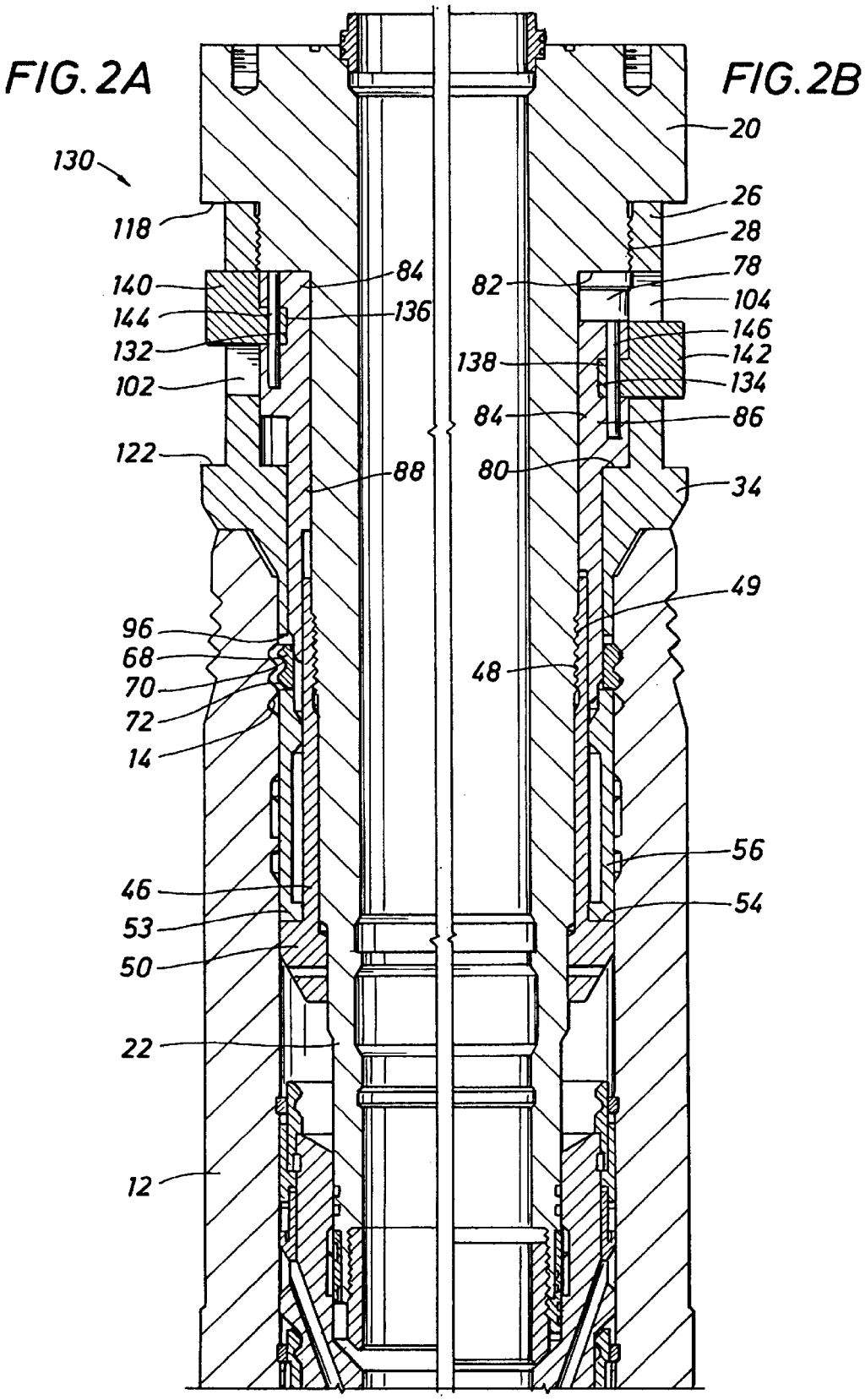
Figures 3A, 3B:
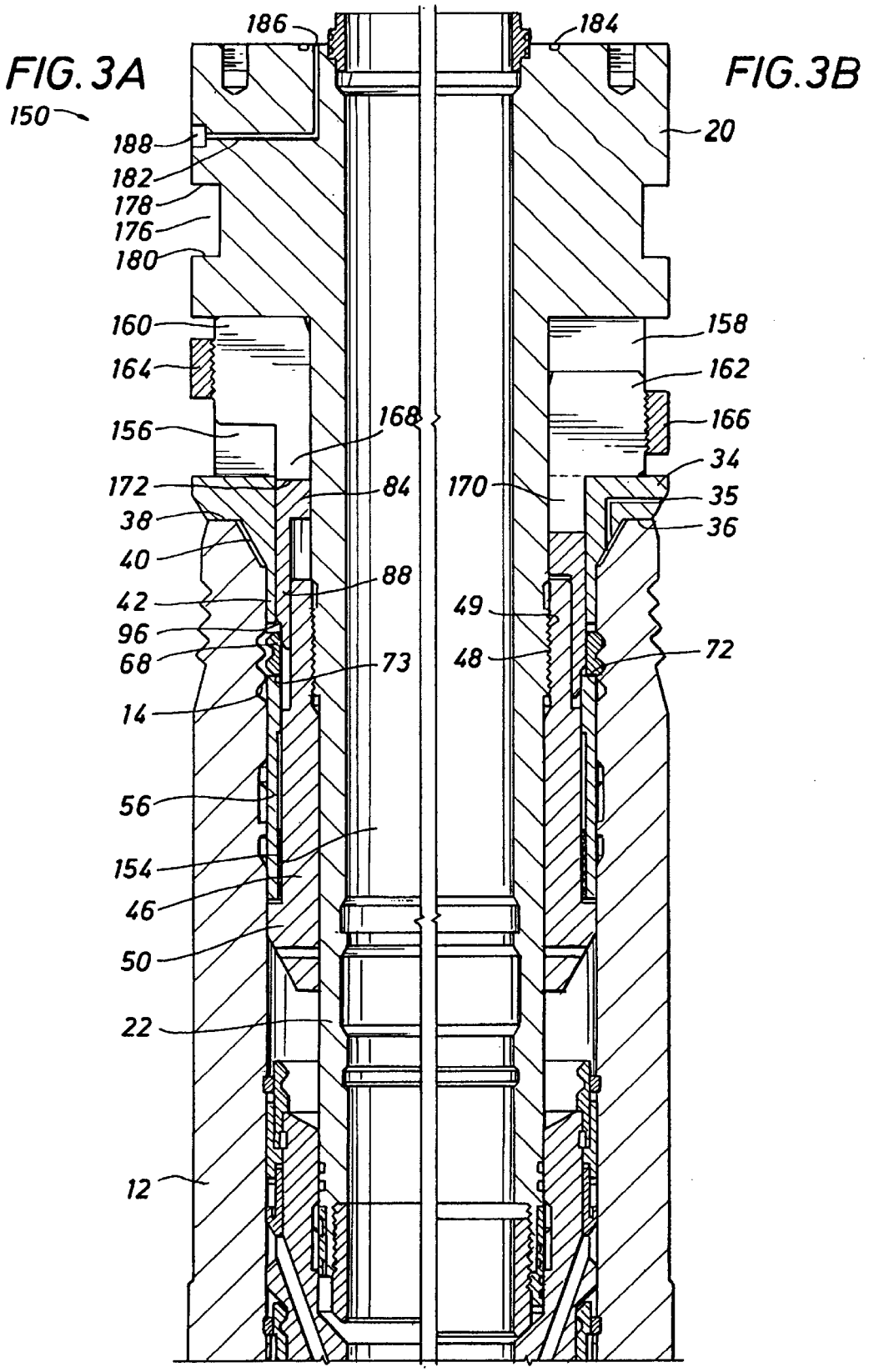

FIG. 1A is a longitudinal sectional view of an externally actuated tieback connector constructed in accordance with the principles of the present invention and representing the preferred embodiment and showing the inner connector body landed on a wellhead and with the internal lock mechanism in the unlocked condition thereof;

FIG. 1B is a longitudinal sectional view similar to that of FIG. 1A and showing the externally actuated tieback connector in the locked and pre-loaded condition thereof;

FIG. 2A is a longitudinal sectional view of an externally actuated tieback connector representing an alternative embodiment of the present invention and showing the inner connector body landed on a wellhead and with the internal lock mechanism in the unlocked condition thereof;

FIG. 2B is a longitudinal sectional view similar to that of FIG. 2A and showing the externally actuated tieback connector in the locked and pre-loaded condition thereof;

FIG. 3A is a longitudinal sectional view of an externally actuated tieback connector representing another alternative embodiment of the present invention and showing the inner connector body landed on a wellhead and with the internal lock mechanism in the unlocked condition thereof; and FIG. 3B is a longitudinal sectional view similar to that of FIG. 3A and showing the externally actuated tieback connector in the locked and pre-loaded condition thereof.

DETAILED DESCRIPTION OF PREFERRED EMBODIMENT

Referring now to the drawings and first to FIGS. 1A and 1B, a tieback connector embodying the principles of the present invention is shown generally at ten and is adapted to be landed for fluid conducting and force resisting connection with a Subsea wellhead 12 having an internal locking groove geometry 14 for tieback connection and other internal locking geometry 16 and 18 which receive expandable locking rings or locking collets of other devices which are locked within the Subsea wellhead 12.

The tieback connector 10 includes a connector body 20 which is adapted for connection such as by bolts, threaded studs, etc. to a flange or other connecting element located at the lower end of a production riser or other conduit structure. From the connector body 20 depends a tubular interconnector body 22, which, as shown in FIGS. 1A and 1B in the landed condition thereof, extends into the subsea wellhead 12. The tubular connector body and its tubular internal-connector element 22 cooperatively defined an internal flow passage 24 through which well fluid is produced. The fluid production passage 24 also permits various well tools to be run into the well so that various well servicing activities can be carried out without requiring disconnection of the riser from the subsea wellhead. An outer tieback connector body 26 is secured by a threaded connection 28 to the connector body 20 and defines an upper annular end surface 30, which is shouldered in force transmitting relation with an annular downwardly directed shoulder 32 of the connector body. At the lower end of the tubular tieback connector body 26 is provided an annular landing section 34 having a downwardly directed annular landing shoulder 36, which lands on an upperwardly directed upper end surface 38 of the wellhead 12 as shown in FIGS. 1A and 1B. The upper end of the wellhead 12 defines a generally conical downwardly and inwardly tapered guide surface 40, which is typically lined with a hard facing material to minimize the potential for damage to the wellhead structure by the tieback connector or by any other apparatus that is run into the wellhead such as during drilling, completion and riser tieback activities. The outer tubular tieback connector body 26 is also provided with a depending tubular section 42, which is received in close fitting relation within the internal cylindrical surface 44 of the wellhead and thus, assist in alignment of the tieback connector with respect to the wellhead.

An adjustable tubular connector 46 is adjustably connected to the tubular internal connector body 22 by an adjustment thread 48 or by any other suitable means for rendering the tubular connector 46 axially adjustable with respect to the tubular internal connector body 22. The tubular connector 46 is provided with an enlarged tapered lower extremity 50, which defines a downwardly and inwardly tapered external guide surface 52, which functions to guide the tieback connector with respect to the tapered internal guide surface 40 of the wellhead 12 as the tieback connector is moved downwardly by its riser or other installation component. The enlarged lower extremity 50 of the tubular connector 46 also defines an upperwardly facing annular shoulder 54, which serves as a stop or support shoulder surface for a tubular lock positioning element 56 disposed in aligned relation with respect to an external cylindrical surface 58 of the tubular connector 46. The tubular lock positioning element 56, for purposes of alignment with respect to the cylindrical surface 58 defines upper and lower internal annular alignment bosses 60 and 62 having guiding contact with the outer cylindrical surface 58 of the adjustable tubular connector. These upper and lower alignment bosses also position the upper generally cylindrical end 64 of the annular lock positioning element 56 in radially spaced relation with the outer cylindrical surface 58 to thus define and annular receptacle 66, the purpose of which will be described below.

A spring-type split lock ring 68, having an external locking geometry 70 matching the internal tieback locking geometry 14 of the wellhead 12 is supported by the upper annular end surface 72 of the lock positioning element 56. The locking ring 68 is typically of the split ring variety enabling it to be expanded from the unlocked position thereof, shown in FIG. 1A to the locked position thereof, shown in FIG. 1B. The position of the lock ring with respect to the locking geometry 14 is determined by the position of the lock positioning element 56 and thus, by the adjustable tubular connector nose 46 relative to the tubular internal connector body 22.

The amount of tensile preload force able to be created or generated by the locking mechanism is a function of two features contained in the tieback mechanism 10, namely (1) the relative location between the internal recessed locking groove 14 of the wellhead and the expanding lock ring 68, and (2) the mechanical advantage between the energizing mandrel and the lock ring for the expanding lock ring 68. The tubular extension of the energizing mandrel defines an external tapered annular actuating shoulder which is disposed in actuating engagement with an inner correspondingly tapered surface of the lock ring. As the external tapered annular actuating shoulder is move downwardly relative to the lock ring, the shoulders interact to develop an outwardly directed force on the lock ring causing its tapered external locking surface or surfaces to interact with the tapered surfaces of the internal locking geometry of the wellhead to cause downward movement of the lock ring against the tubular lock positioning element. Since the tubular lock positioning element is supported by the support shoulder 54 of the adjustable tubular connector, the tubular lock positioning element is subjected to compressive deformation or buckling while at the same time applying tensile force to the adjustable connector element 46 and to the inner connector body 22.

The depending tubular section 22 of the connector body 20 defines an external cylindrical surface 74 which is of smaller diameter as compared to an internal cylindrical surface 76 of the outer tubular tieback connector body 26, thus, causing the cylindrical surfaces 74 and 76 to be radially spaced so as to define an energizer annulus or receptacle 78. The annular energizer receptacle 78 is defined in part by an upwardly facing annular stop shoulder 80, which is located internally of the tubular tieback connector body 26. The upwardly facing annular stop shoulder 80 serves as a stop to limit downward travel of the upper annular actuating section 86 of a lock energizer mandrel 84. A downwardly directed annular shoulder 82 defined by the tieback connector body 20 externally of the tubular internal connector body section 22 defines the upper limit of the annular energizer receptacle 78. The lock energizer mandrel 84 is of tubular configuration and is moveably located about the tubular internal connector body 22 with an upper annular actuating section 86 thereof moveable linearly between the stop shoulders 80 and 82 from an unlocked position shown in FIG. 1A to a locked position shown in FIG. 1B. The lock or lock energizing mandrel 84 includes a tubular depending lock actuating section 88, which is cut away internally as shown at 90 to define an annular receptacle for receiving the upper tubular end 92 of the adjustable tubular connector 46. A lower annular lock spacer element 94 defines the lower end of the tubular lock actuating section 88 of the energizing mandrel. The lock spacer end 94, in the unlocked condition shown in FIG. 1A, is located internally of the lock ring 68 for radial positioning of the lock ring, but without expanding the lock ring. An external tapered annular shoulder 96 establishes a lock actuating or expanding transition between the outer diameter of the annular lock spacer element 94 and the outer diameter of the depending tubular lock actuating section 88. As the energizing mandrel 84 is moved downwardly from the unlocked position shown in FIG. 1A to the locked position shown in FIG. 1B, the tapered annular shoulder 96 will cause expansion of the spring-like lock ring 68 thereby forcing its external locking geometry 70 into locking engagement with the internal locking geometry 14 of the tubular wellhead structure 12. Conversely, when the energizing mandrel 84 is moved upwardly within the energizer annulus or receptacle 78 from the position shown in FIG. 1B to the unlocked position shown in FIG. 1A, the cylindrical lock positioning surface 98 of the tubular lock actuating section 88 will be withdrawn from within the lock ring 68. Thus, the spring-like characteristics of the lock ring will cause it to return to its original, non-expanded condition as shown in FIG. 1A, thus retracting its locking geometry 70 from the internal lock geometry 14 of the wellhead 12.

The relative location between the wellhead housing's recessed internal groove 14 and the expanding lock ring 46 is caused by positioning the expanding lock ring a few thousands of an inch above the recessed internal locking groove geometry of the wellhead 12. If the expanding lock ring were to be positioned or spaced at the same location as the recessed internal groove geometry 14, the lock ring would simply expand into the recessed groove and would not exert any upwardly directed pre-load force on the tapered entry surface 100 of the internal locking groove geometry within the wellhead 12. Thus, by adjusting the position of the tubular connector 46 relative to the energizing mandrel 84, by rotating the adjustment thread 48, the external locking geometry of the lock ring 68 can be caused to interact with the tapered entry surface of the internal locking geometry of the wellhead to thereby generate an upwardly directed pre-load force that is required for the tieback connector. However, since the expanding lock ring 28 is located and positioned above the recessed internal groove of the wellhead, the tapered shoulders of the lock ring will come into contact with the tapered entry of the wellhead internal locking geometry or groove, which directly causes the resulting stretching of the body of the tieback connector until the lock ring can fully enter the recessed internal groove geometry of the wellhead. Note that the greater the relative distance, the greater will be the resulting stretching (or pre-load) force that will be caused to be generated. Thus, by rotating the adjustable tubular connector nose 46 in a selected rotational direction, the pre-load force caused by controlled location of the lock ring 68 relative to the internal locking geometry or grooves 14 of the wellhead, will establish the desired pre-load force of the tieback connector mechanism. This adjustment can be made at a time when the tieback connector is located at deck level of the spar or platform or in the alternative, it can be made in the subsea environment by rotating the adjustable tubular by means of a ROV or other adjustment tool prior to establishing the tieback connection. With the adjustment being in the form of a threaded connection as shown, the adjustable tubular 46 may be adjusted upwardly or downwardly to accommodate differences that will exist in the machining tolerances between the wellhead housing and the tieback connector. This allows the specific amount of pre-load force desired to be simply dialed-in (e.g., as the higher the adjustment ring is moved, the greater the amount of pre-load force will be generated.)

The structure of the tie-back connector produces the mechanical advantage that is required to facilitate and generate the high pre-load force of the connector without the need to generate a large associated hydraulic force that would otherwise required for the connector. This is accomplished as a result of the physical geometries between the energizing mandrel and the expanding lock ring with respect to each respective radii on the respective surfaces that are present at the location of contact between the energizing mandrel and the lock ring. When the energizing mandrel and the lock ring touch and roll by each other over the radiused surfaces during the locking process, the relative angle that the load path takes is very small. This action creates an enhanced mechanical advantage between the two parts, on the order of approximately 27:(1) in the preferred embodiment of the invention. Accordingly, when the energizing mandrel is driven downwardly with a force approximating 29,500 pounds downward force, this force is translated to 810,000 pounds of locking force acting on the lock ring 68.

As mentioned above, most tieback connector mechanisms are hydraulically actuated, thus requiring the provision of a hydraulically energized mechanism for accomplishing locking and unlocking of a locking ring with respect to internal wellhead locking geometry. Moreover, the requirement for hydraulic energization requires the provision of an internal hydraulically energized piston and an appropriate hydraulic supply for control and actuation of the piston and thus the locking mechanism. According to the present invention, a simplified, externally actuated locking and unlocking mechanism is provided for the tieback connector of FIGS. 1A and 1B as well as the other figures of the drawings. To facilitate linear movement of the energizing mandrel 94 within its annular receptacle 78, and for thus causing linear movement of the tubular lock actuating section 88 thereof, within the annular space that is provided, the outer tubular tieback connector body 26 defines opposed elongate slots 102 and 104. A pair of external actuators or drive members 106 and 108 are received within internal drive receptacles 110 and 112 respectively of the upper annular actuating section 86 of the lock energizing mandrel 84. The drive members 106 and 108 are moveable linearly within limits defined by the length of the elongate slots 102 and 104. The drive members 106 and 108 are each provided with drive heads 114 and 116, respectively, that may be threaded to the respective drive members or manufactured integrally therewith if desired, to thus provide drive head elements that overly the width of the elongate slots 102 and 104. Since the drive members 106 and 108 are exposed externally of the outer tubular connector body 26 they can be engaged by the actuating mechanism of a ROV or by any other actuator tool that is capable of causing linear actuation of the energizing mandrel.

To accommodate reaction forces as actuating force is applied to the energizing mandrel, the upper portion of the connector body 20 defines an annular upper reaction shoulder 118 which is engaged by an appropriate actuating tool of an energizing mandrel actuator, not shown. The energizing actuator mandrel may, if desired, be provided by an appropriate manipulator mounted to and actuated by a ROV operating in the subsea environment. Alternatively, an actuating tool may be run down the riser from the working level of a spar or other semisubmersible platform which can be energized in controlled fashion for engaging and providing force to the drive heads 114 and 116 and thus to the drive members 106 and 108. The actuator mechanism will impart force to the annular reaction shoulder 118 and to the respective mandrel drive members, causing downward movement of the drive members to thus force the energizing mandrel 84 to move downwardly until the lower annular shoulder 120 thereof establishes contact with the upwardly facing annular stop shoulder 80, thus defining the limit of downward travel of the energizing mandrel relative to the outer tubular tieback connector body 26.

For achieving upward movement of the energizing mandrel 84, to permit retraction of the lock ring 68, the outer tubular tieback connector body 26 defines an upwardly facing annular lower reaction shoulder 122 which is engageable by an appropriate mandrel actuating tool, which may be the same actuating tool as is utilized for achieving downward movement of the of the energizing mandrel 84. The actuating tool will engage the appropriate drive members 106 and 108, or the drive heads thereof, and will apply force to the annular reaction shoulder 122 and to the drive members to thus force the energizing mandrel to move upwardly until its upper annular end surface 124 contacts and is restrained by the annular downwardly facing shoulder 82 of the connector body structure 20.

Thus, a simple tieback lock manipulating tool, which is not an integrated component of the tieback connector mechanism can be utilized for both locking and unlocking of the tieback connector mechanism. This simple actuating tool may be provided by a subsea ROV or it may be provided by any other mechanism that is capable of controllably reaching the depth level of the subsea tieback connector and causing controlled movement of the energizing mandrel 84 either upwardly or downwardly as desired. The respective drive elements 106 and 108 guided during linear movement thereof by the wall surfaces of the elongate guide slots 102 and 104 and are retained within the respective receptacles 110 and 112 of the upper annular actuating section 86 by retainer bolt members 126 and 128. The external actuators 114 and 116 are exposed for engagement by the manipulating devices of an actuating mechanism, such as a ROV, which is capable of reaching and operating in the water depth of the wellhead. To permit the actuating mechanism to apply linear force to the external actuators 114 and 116, the actuating device is enable to establish force reaction contact with one or both of the reaction shoulders 118 and 122. Since the tieback connector mechanism is not required to have an integrated actuating system therein, it will logically be of significantly less expensive nature as compared with conventional hydraulically energized wellhead tieback connectors.

Referring now to FIGS. 2A and 2B, an alternative embodiment of the present invention is shown generally at 130 and incorporates many features and components that are shown and described above in connection with FIGS. 1A and 1B. Like parts are represented by like reference numerals. A lock or locking ring energizer mandrel 86 is position with its upper actuating end located within an annulus or receptacle 78 and being linearly moveable within the annulus within limits defined by annular stop shoulders 80 and 82. A tubular lock actuating section 88 of the energizing mandrel 86 is linearly moveable within an annular space between the wellhead 12 and a tubular inner connector body extension 22, which is an integral component of the tieback connector body 22. The tubular inner connector body extension 22 carries various seals for establishing tieback sealing with internal sealing components of the wellhead assembly.

As shown in FIG. 2A, the tubular lock actuating section 88 of the energizing mandrel 86 linearly positionable at an unlocking or release position permitting the spring-like locking ring 68 to retract its external locking geometry 70 from the internal locking geometry 14 of the wellhead. In the FIG. 2A position of the tubular lock actuating section 88 of the energizing mandrel 86, the connector body 20 and its tubular inner connector body extension 22 may be inserted into or withdrawn from the wellhead 12. As shown in FIG. 2B, the tubular lock actuating section 88 of the energizing mandrel 86 linearly positionable at a locking or locking position wherein the tubular lock actuating section 88 is located within the inner periphery of the spring-like locking ring 68, causing expansion of the locking ring to position its external locking geometry 70 in locking relation with the internal locking geometry 14 of the wellhead. Since it is desirable, according to the concept of the present invention to apply a pre-load force to the locking ring when it is expanded to its locking or locking position, an adjustable tubular connector 46 is provided with an internal adjustment thread section 48 which engages an externally threaded adjustment section 49 of the tubular inner connector body extension 22. By rotating the adjustable tubular connector 46, its adjustment thread connection with the tubular inner connector body extension 22 will accomplish linear adjustment of the position of an annular lock positioning element 56 having its lower end 53 disposed in supported, force transmitting relation with an upwardly facing annular support shoulder 54 of the lock positioning element 56. The upper annular end 72 of the lock positioning element 56 provides for support and positioning of the lock ring 68 so that the position of the lock ring can be adjusted so that its tapered cam surfaces will engage and provide a pre-load force to the inner locking geometry 14 of the wellhead 12. The adjustment threads 48–49 enable precise adjustment of the annular lock positioning element 56 and the lock ring so that the magnitude of the pre-load force can be precisely established. Adjustment of the annular lock positioning element 56 and the lock ring is done before the tieback connector is positioned in tieback assembly with the wellhead.

The energizing mandrel 86 differs from the energizing mandrel shown in FIGS. 1A and 1B in that its uppermost section defines a actuator recesses 132 and 134 which receive, respectively, actuator projections 136 and 138 of external actuator elements 140 and 142 which project through and are guided by the elongate guide slots 102 and 104 of the outer tubular tieback connector body 20. Retainer pins 144 and 146 are utilized to secure the actuator projections 136 and 138 in locked assembly.

To establish tieback of a riser with respect to the wellhead 12 the tieback connector, with its locking mechanism positioned as shown in FIG. 2A, is moved downwardly to move the tubular inner connector body extension 22 into seated and sealed relation with internal components of the wellhead assembly. After the annular landing section 34 of the tubular tieback connector body 26 has engage the upwardly facing annular end of the wellhead 12, as shown in FIG. 2A, an external lock actuating device, which can be an actuating assembly of a ROV, is brought into actuating engagement with the external actuator elements 140 and 142 and also establishes force reaction engagement with one or both of the annular force reaction shoulders 118 and 122. The actuating assembly of the external lock actuating device is then energized in any suitable fashion to apply upward or downward force to the external actuator elements 140 and 142, thus moving them and the lock energizing mandrel upwardly or downwardly as the case may be for releasing the lock ring as shown in FIG. 2A or expanding the lock ring as shown in FIG. 2B. The pre-load force applied by the lock ring to the internal locking geometry 14 of the wellhead 12 will be determined by controlled adjustment of the threads 48–49 by appropriate clockwise or counterclockwise rotation of the adjustable tubular connector 46 relative to the tubular lock actuating section 88 of the lock energizing mandrel 84.

Another alternative embodiment of the present invention is shown generally at 150 in FIGS. 3A and 3B, with FIG. 3A representing the unlocked or released condition of the tieback connector lock or lock mechanism and with FIG. 3B representing the locked or locked and pre-loaded condition of the tieback connector lock or lock mechanism. Here again, many of the components and structures of the wellhead tieback connector shown in FIGS. 3A and 3B are identical or quite similar in structure and function as compared to the tieback connector embodiments of FIGS. 1A, 1B, 2A and 2B. Thus like parts are referred to by like reference numerals.

In view of the foregoing it is evident that the present invention is one well adapted to attain all of the objects and features hereinabove set forth, together with other objects and features which are inherent in the apparatus disclosed herein.

As will be readily apparent to those skilled in the art, the present invention may easily be produced in other specific forms without departing from its spirit or essential characteristics. The present embodiments, therefore, are to be considered as merely illustrative and not restrictive, the scope of the invention being indicated by the claims rather than the foregoing description, and all changes which come within the meaning and range of equivalence of the claims are therefore intended to be embraced therein.

We claim:

1. A method for establishing a tieback connection between a subsea wellhead and a riser with a tieback connector having a locking mechanism for locking connection with the subsea wellhead and a lock energizer being moveable within the tieback connector and having at least one moveable actuating portion thereof exposed externally of the tieback connector, said method comprising:

positioning the tieback connector with said locking mechanism located within the wellhead and positioned for locking therein; and selectively moving said at least one externally exposed moveable actuating portion of at least one said lock energizer and causing selective movement of said lock energizer by said at least one moveable actuation portion to a locking or unlocking position causing said lock actuator to establish locking of the tieback connector within the wellhead or to release locking of the tieback connector from within the wellhead.

2. The method of claim 1, wherein the wellhead defines an internal connection geometry and said locking mechanism has a lock ring adapted for expansion to locking engagement with the internal connection geometry and contraction for releasing locking engagement from the internal connection geometry and an adjustable lock ring support for restraining linear movement of said lock ring during expansion and positioning the lock ring for development of a pre-load force on the internal connection geometry of the wellhead, said method comprising:

before said positioning step, adjustably positioning said lock ring support relative to said tieback connector;

moving said externally exposed actuating portion and said lock energizer for expanding said lock ring to locking engagement with the internal locking geometry of the wellhead; and further moving said externally exposed actuating portion and said lock energizer for expanding said lock ring while simultaneously supporting said lock ring to restrain its force responsive linear movement, thus causing said lock ring to expand and establish a predetermined pre-load force on the wellhead at the internal locking geometry.

3. The method of claim 1, comprising:

establishing force reaction engagement with the tieback connector and establishing actuating connection with said external actuating portion of said lock energizer; and applying force to said external actuating portion of said lock energizer in a selective direction for locking or unlocking said locking mechanism of said tieback connector.

4. The method of claim 1, wherein the tieback connector has a body with a portion thereof exposed to the marine environment when tieback connection is made within the subsea wellhead, said method comprising:

establishing force reaction connection with the body of the tieback connector;

establishing actuating connection with said external actuating portion of said lock energizer; and moving said external actuating portion of said lock energizer in a selected direction for locking or unlocking said locking mechanism, while maintaining said force reaction connection with the body of the tieback connector.

5. An externally actuatable tieback connector for establishing fluid communication and force resisting connection of a conduit to a subsea wellhead having an internal locking geometry, comprising:

a tubular outer body;

a tubular inner body being connected to said tubular outer body and adapted to extend partially into an inner diameter of the wellhead;

a lock ring located circumferentially around a portion of said inner tubular body and disposed for locking engagement with the internal locking geometry of the wellhead;

a lock energizing element being movable relative to said tubular outer body and said tubular inner body and having a portion thereof disposed for actuating engagement with said lock ring and having a locking position expanding said lock ring into locking engagement with the internal locking geometry of the wellhead and an unlocking position permitting retraction of said lock ring to a position clear of the internal locking geometry of the wellhead; and at least one drive member extending from said lock energizing element and having a portion thereof positioned externally of said outer tubular connector body for engagement and actuating movement.

6. The externally actuatable tieback connector of claim 5, wherein the internal locking geometry of the wellhead having at least one internal annular tapered wellhead locking surface, said externally actuatable tieback connector comprising:

said lock ring being a split ring having at least one annular locking surface oriented for locking engagement with the internal annular tapered wellhead locking surface, said lock ring being expandable for locking said tieback connector to the wellhead and contractible for releasing said tieback connector from locked relation within the wellhead.

7. The externally actuatable tieback connector of claim 6, comprising:

said lock energizing element having a tapered lock ring actuating section disposed for expansion actuation of said lock ring during linear movement of said lock energizing element relative to said tubular outer body and said tubular inner body; and a lock ring positioning support being provided on said inner tubular body for supporting said lock ring at a predetermined position for development of a pre-load force thereof on the internal locking geometry of the wellhead.

8. The externally actuatable tieback connector of claim 7, comprising:

said lock ring positioning support being adjustable relative to said inner tubular body for changing said desired pre-load force.

9. The externally actuatable tieback connector of claim 7, comprising:

said inner tubular body having a threaded adjustment section;

an adjustable tubular connector having threaded engagement with said threaded adjustment section and defining a support shoulder;

an annular lock positioning element being supported by said support shoulder and having positioning and supporting engagement with said lock ring.

10. The externally actuatable tieback connector of claim 5, comprising:

said outer tubular connector body defining at least one elongate actuator connector slot having said drive member projecting therethrough and with a portion of said drive member exposed externally of said outer tubular connector body.

11. The externally actuatable tieback connector of claim 5, comprising:

said outer tubular body defining a landing shoulder for landing at the upper end of the wellhead.

12. An externally actuatable tieback connector for establishing fluid communication and force resisting connection of a conduit to a subsea wellhead having an internal locking geometry, comprising:

a connector body having a portion thereof adapted to be received within an inner diameter of the subsea wellhead;

a lock ring located circumferentially around a portion of said connector body and disposed for locking engagement with the internal locking geometry of the wellhead;

a lock energizer element being movable relative to said connector body and having a portion thereof disposed for actuating engagement with said lock ring and having a locking position expanding said lock ring into locking engagement with the internal locking geometry of the wellhead and an unlocking position permitting retraction of said lock ring to a position clear of the internal locking geometry of the wellhead; and at least one drive member extending from said lock energizer element and having a portion thereof positioned externally of said connector body for engagement and actuating movement.

13. The externally actuatable tieback connector of claim 12, comprising:

a lock support being adjustably supported by said connector body and having supporting relation with said lock ring, said lock support being selectively adjustable relative to said connector body for establishing desired pre-load force of said lock ring against said internal locking geometry of the wellhead.

14. The externally actuatable tieback connector of claim 12, wherein said lock support comprising:

a support adjustment thread being provided on an external section of said support body;

an adjustable tubular connector having threaded engagement with said support adjustment thread and being adjustable for pre-load force adjustment; and an annular lock positioning element having threaded engagement with said adjustable tubular connector and having supporting engagement with said lock ring and also being adjustable relative to said adjustable tubular connector for also controlling desired pre-load force of said lock ring against said internal locking geometry of the wellhead.

15. The externally actuatable tieback connector of claim 12, comprising:

said support body defining at least one lock energizer recess; and a lock energizer being movably disposed within said lock energizer recess and having a portion thereof exposed for manipulation by a lock actuation tool located externally of the connector body and wellhead, said lock energizer also having a portion thereof disposed for actuating engagement with said lock ring.

16. The externally actuatable tieback connector of claim 12, comprising:

at least one force reaction shoulder being defined by said connector body;

said at least one drive member being selectively moveable relative to said at least one force reaction shoulder for moving said lock energizer element to a locking position expanding said lock ring and an unlocking position releasing said locking ring for contraction of said locking ring from the internal locking geometry within the wellhead.

* * * * *